US007357688B2

(12) United States Patent
Ferrara

(10) Patent No.: US 7,357,688 B2
(45) Date of Patent: Apr. 15, 2008

(54) FLOATATION APPARATUS AND METHOD

(76) Inventor: Thomas B. Ferrara, 7 Elm Ct., Albany, NY (US) 12205

( * ) Notice: Subject to any disclaimer, the term of this patent is extended or adjusted under 35 U.S.C. 154(b) by 280 days.

(21) Appl. No.: 10/803,378

(22) Filed: Mar. 18, 2004

(65) Prior Publication Data

US 2005/0208849 A1 Sep. 22, 2005

(51) Int. Cl.

| | |
|---|---|
| ***B63B 35/58*** | (2006.01) |
| ***B63B 35/607*** | (2006.01) |
| ***B63B 35/613*** | (2006.01) |
| ***B63C 9/00*** | (2006.01) |

(52) U.S. Cl. ..... 441/35; 441/38; 441/39; 441/40; 114/345

(58) Field of Classification Search ..... 441/125–133, 441/35–43; 114/345, 348–350, 61.23, 61.25, 114/264; 472/128, 129; 446/153
See application file for complete search history.

(56) References Cited

U.S. PATENT DOCUMENTS

| | | | | | |
|---|---|---|---|---|---|
| 744,590 | A | | 11/1903 | Moore | |
| 1,053,472 | A | | 2/1913 | Boatright | |
| 2,390,199 | A | * | 12/1945 | Walsh | 441/41 |
| 2,764,766 | A | * | 10/1956 | Boyle et al. | 441/38 |
| 2,879,735 | A | | 3/1959 | Pointer | |
| 2,933,739 | A | * | 4/1960 | Ford et al. | 441/40 |
| 2,946,068 | A | | 7/1960 | Jasper | |
| 3,034,154 | A | * | 5/1962 | Silverstone | 441/38 |
| 3,092,854 | A | * | 6/1963 | Manhart | 441/38 |
| 3,109,183 | A | | 11/1963 | Overmyer | |
| 3,752,102 | A | | 8/1973 | Shuman | |
| 3,760,754 | A | | 9/1973 | Drummond et al. | |
| 3,857,352 | A | | 12/1974 | Schott | |
| 4,409,921 | A | | 10/1983 | Carroll et al. | |
| 4,733,626 | A | | 3/1988 | Svirklys et al. | |
| 4,750,894 | A | * | 6/1988 | Nealey | 441/40 |
| 4,828,520 | A | * | 5/1989 | Baughman et al. | 441/40 |
| 4,878,311 | A | * | 11/1989 | Cano | 43/54.1 |
| 4,988,317 | A | | 1/1991 | Rubinsak et al. | |
| 5,251,113 | A | * | 10/1993 | Wagoner et al. | 362/190 |
| 5,301,630 | A | * | 4/1994 | Genovese et al. | 114/375 |
| 5,324,221 | A | * | 6/1994 | Kaufman et al. | 441/129 |
| 5,615,640 | A | * | 4/1997 | Luiz | 119/482 |
| 5,628,275 | A | * | 5/1997 | Casey | 119/28.5 |
| 6,135,045 | A | | 10/2000 | Staff | |
| 6,223,673 | B1 | * | 5/2001 | Mears et al. | 114/264 |
| 2003/0121463 | A1 | | 7/2003 | Rice | |

FOREIGN PATENT DOCUMENTS

JP 05246382 A * 9/1993

* cited by examiner

*Primary Examiner*—Ajay Vasudeva
(74) *Attorney, Agent, or Firm*—Gerald F. Dudding; GFD Patents LLC

(57) ABSTRACT

A portable floatation apparatus comprising a platform, a ramp, and a buoyancy structure non-removably attached to the platform. At least one buoyancy structure may be removably attached under the platform to adjust the buoyancy of the floatation apparatus. The platform may be perforated to allow liquids to drain through the perforations. A membrane structure may be removably attached to a bottom side of the floatation apparatus to capture any liquid draining through the perforations. The floatation apparatus is adapted to support an animal, such as a pet dog or a pet cat, over the body of water.

28 Claims, 6 Drawing Sheets

FLOATATION APPARATUS AND METHOD

BACKGROUND OF THE INVENTION

1. Technical Field

This invention generally relates to floatation devices and methods of use, and more specifically relates to water floatation devices and methods of use.

2. Related Art

A floatation apparatus may be used in private and public swimming pools, lakes, rivers, ponds, and the ocean, for example, as swimming aides, floatation exercisers, and as water toys. There is a need for a floatation apparatus that may be used for various applications.

SUMMARY OF THE INVENTION

The present invention provides a floatation apparatus, comprising:

a platform structure;

a permanent buoyancy structure physically attached to a first side of the platform structure; and at least one removable buoyancy structure removably attached to the floatation apparatus, wherein the floatation apparatus is portable.

The present invention provides a floatation apparatus, comprising:

a platform structure; and a buoyancy structure physically attached to a first side of the platform structure, wherein the floatation apparatus is portable, and wherein the floatation apparatus is adapted to support a dog over water.

The present invention provides a method, comprising:

providing a portable floatation apparatus comprising a permanent buoyancy structure physically attached to a first side of a platform structure;

removably attaching at least one removable buoyancy structure to the floatation apparatus; and placing the portable floatation apparatus in water.

The present invention provides a method, comprising:

providing a portable floatation apparatus, comprising a permanent buoyancy structure physically attached to a first side of a platform structure;

placing the portable floatation apparatus in water;

placing a dog on the portable floatation apparatus; and supporting by the portable floatation apparatus, the dog over the water.

The present invention advantageously provides a structure and associated method for a floatation apparatus that may be used for various applications.

DETAILED DESCRIPTION OF THE INVENTION

Figure 1:
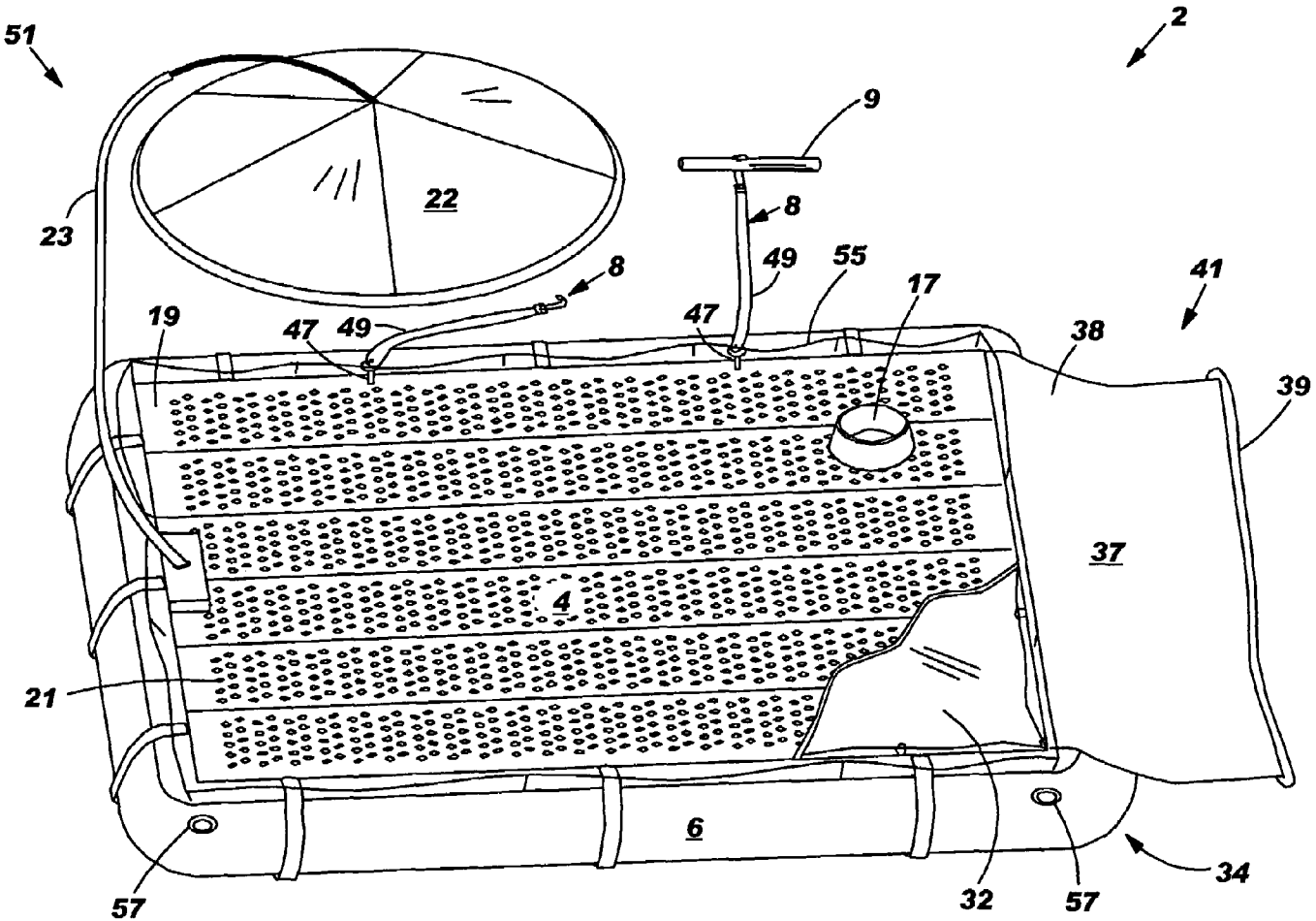
FIG. 1 illustrates a perspective top view of a portable floatation apparatus, in accordance with embodiments of the present invention.
Figure 2:
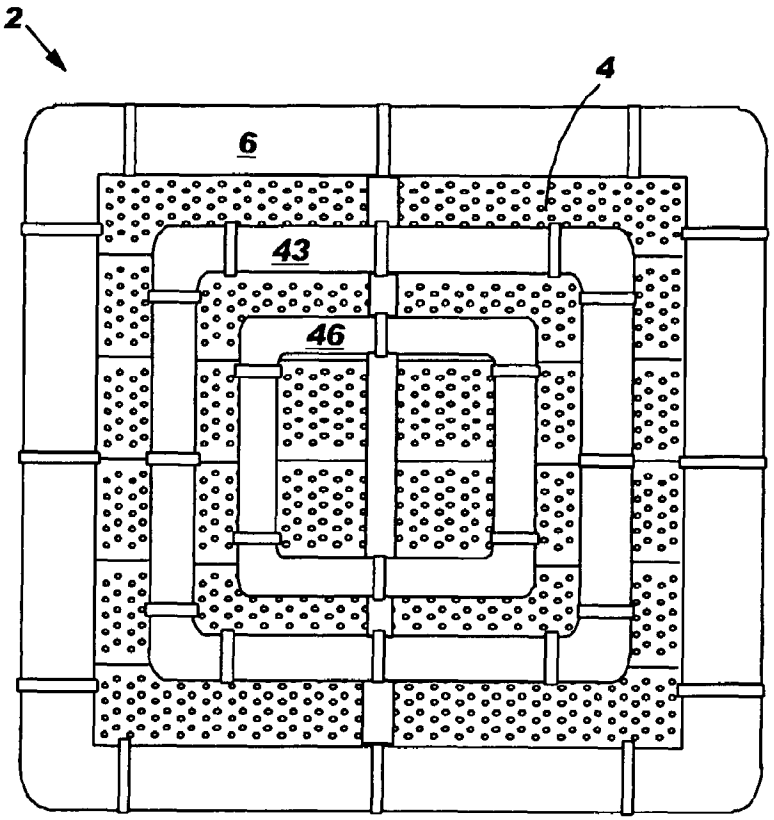
FIG. 2 illustrates a perspective bottom view of the portable floatation apparatus of FIG. 1 with additional buoyancy structures, in accordance with embodiments of the present invention.

FIG. 1 illustrates a perspective top view of a portable floatation apparatus 2, in accordance with embodiments of the present invention. The term "portable floatation apparatus" 2 is defined herein including in the claims as a lightweight apparatus (i.e, less than about 40 pounds), easy to drag across the ground, such as, inter alia, across sand and/or pebbles at the beach, and transport, carry, or lift onto a boat or up to an above ground pool. The floatation apparatus 2 comprises a platform structure 4 physically attached to a buoyancy structure 6 and may comprise at least one attachment structure 8 (two shown in FIG. 1) for securing the floatation apparatus 2 to an object 9. Note that the shape (rectangular with rounded corners) of the portable floatation apparatus 2 in FIG. 2 is shown for illustration purposes and the portable floatation apparatus 2 may comprise any shape known to a person of ordinary skill in the art including, inter alia, square, triangular, hexagon, polygon, circular, etc. Any of said shapes may comprise rounded corners. The floatation apparatus 2 is adapted to float in a body of water such as, inter alia, a swimming pool (e.g., swimming pool 10 depicted in FIG. 4), a lake, a river, an ocean, etc.

The at least one attachment structure 8 may be used to secure the floatation apparatus 2 to the object 9 (e.g., maybe a wall or top rail of swimming pool 10 in FIG. 4, a boat, a dock, etc.) to prevent the floatation apparatus 2 from floating away from the object 9. The at least one attachment structure 8 may be physically attached to a surface of the floatation apparatus 2. The at least one attachment structure 8 may comprise a hooking device 47 and a strap 49. The hooking device 47 connects the strap 49 to the floatation apparatus 2. The hooking device 47 maybe any hooking device known to a person of ordinary skill in the art including, inter alia, eye bolts, hooks, etc. The strap 49 maybe any strap known to a person of ordinary skill in the art including, inter alia, a bungee cord (e.g., made of any synthetic material such as, inter alia, elastic), a nylon zip tie, a lock tie, a tie down, a utility strap, rope, etc. The strap 49 may comprise hooking or latching devices including, inter alia, a bolt snap, a trigger snap, a spring snap, a breeching snap, a carabiner, etc. The floatation apparatus 2 maybe used as a floating platform to support an animal 25 (see FIG. 4) over the body of water. The animal 25 may be, inter alia, a pet dog, a pet cat, etc. The buoyancy structure 6 may be any buoyant structure known to a person of ordinary skill in the art including, inter alia, an inflatable buoyancy structure, a hollow tubular (e.g., using polyvinylchloride (PVC) tubing) buoyancy structure, a polystyrene buoyancy structure, etc. The buoyancy structure 6 may comprise any buoyant material known to a person of ordinary skill in the art including, inter alia, plastic, PVC, polystyrene, wood, etc. The platform structure 4 may comprise any material including, inter alia, plastic, wood, PVC, fiberglass, etc. The floatation apparatus 2 may additionally comprise a bowl structure 17 mechanically attached to a top surface 19 of the platform structure 4. Alternatively, the bowl structure 17 may be recessed within the top surface 19 of the platform structure 4. The bowl structure 17 may be used to hold a supply of food and/or drinking water for the animal 25 (e.g., a pet dog, a pet cat, etc.) on the floatation apparatus 2. The platform structure 4 may be perforated to allow liquid (e.g., water) to drain through perforations 21 and off of the floatation apparatus 2. Each perforation 21 may be circular in shape and comprise a diameter of less than about ½ of an inch. Alternatively, each perforation 21 may comprise any closed (i.e., border On all sides) polygon including, inter alia, square, triangular, etc. The term "removably attached" is defined herein including in the claims as a temporary attachment of a structure that does not require the use of any tools to attach or remove (e.g., using clips, locking pins, hinges, cotter pins, etc). The floatation apparatus 2 may additionally comprise a membrane structure 32 removably attached to a bottom side 34 of the floatation apparatus 2. The membrane structure 32 may be used to capture any liquid (e.g., water) draining through perforations 21 so that the liquid does not enter the pool. Alternatively, the membrane structure 32 may be used to filter any liquid (e.g., water) draining through perforations 21 so that the liquid is filtered before it enters the pool. The floatation apparatus 2 may additionally comprise a ramp 37 removably attached to any section of the floatation apparatus 2. The ramp 37 comprises a platform 38 and a buoyancy structure 39, The ramp 37 provides a walkway from the perforated platform structure 4 to the water that the animal 25 (see FIG. 4) may transverse to enter and exit the water. The buoyancy structure 39 provides support for the ramp 37 so that the ramp does not become submerged under water during use (e.g., when the animal 25 steps onto the ramp to enter or exit the water). A plurality of buoyancy structures (e.g., buoyancy structures 43 and 46 in FIG. 2 and buoyancy structures 59, 60 and 61 in FIG. 3) may be attached to the floatation apparatus 2 to increase the buoyancy (e.g., to support a heavier load) of the floatation apparatus 2. The floatation apparatus 2 may comprise a shading structure 51 for providing shade for the floatation apparatus 2 by blocking the sun from irradiating the floatation apparatus 2. The shading structure 51 comprises a shading device 22 attached to a resilient member 23. The shading structure 51 may be any shading structure known to a person of ordinary skill in the art including, inter alia, an umbrella, a canopy, etc. The shading structure 51 may be removably attached to the floatation apparatus 2. Alternatively, the shading structure 51 may be removably attached to the abject 9. An optional barrier structure 55 may be placed around a perimeter of the platform structure 4 to secure the animal 25 (see FIG. 4) within the perimeter of the platform structure 4. The barrier structure 55 may be removably attached to the platform structure 4 and/or the buoyancy structure 6. The baffler structure 55 may be any barrier structure 55 known to a person of ordinary skill in the art including, inter alia, a fence, netting, a dog house, etc. The floatation apparatus 2 may additionally comprise decorative lighting devices 57. The decorative lighting devices 57 may be attached to the buoyancy structure 6 in FIG. 1. The decorative lighting devices 57 may be placed anywhere on or within the floatation apparatus 2. The decorative lighting devices 57 may be any decorative lighting devices 57 known to a person of ordinary skill in the art including, inter alia, fiber optic lighting, incandescent lighting, florescent lighting, halogen lighting, etc. The decorative lighting devices 57 may be powered using a battery(s).

FIG. 2 illustrates a bottom view of the portable floatation apparatus 2 of FIG. 1 with additional buoyancy structures 43 and 46, in accordance with embodiments of the present invention. In contrast with FIG. 1, buoyancy structures 43 and 46 may be removably attached to the portable floatation apparatus 2. The buoyancy structures 43 and 46 may be removably attached to the buoyancy structure 6 and/or the platform structure 4. The buoyancy structure 43 may comprise a smaller perimeter than the buoyancy structure 6. The buoyancy structure 46 may comprise a smaller perimeter than the buoyancy structure 43. Each of the buoyancy structures 6, 43, and 46 may comprise any shape known to a person of ordinary skill in the art including, inter alia, square, triangular, hexagon, polygon, tubular, circular, etc. As with the buoyancy structure 6 the buoyancy structures 43 and 46 may be any buoyant structures known to a person of ordinary skill in the art including, inter alia, an inflatable buoyancy structure, a hollow tubular (e.g., using polyvinylchloride (PVC) tubing) buoyancy structure, a polystyrene buoyancy structure, etc. The buoyancy structures 43 and 46 may comprise any buoyant material known to a person of ordinary skill in the art including, inter alia, plastic, PVC, polystyrene, wood, etc.

Figure 3:
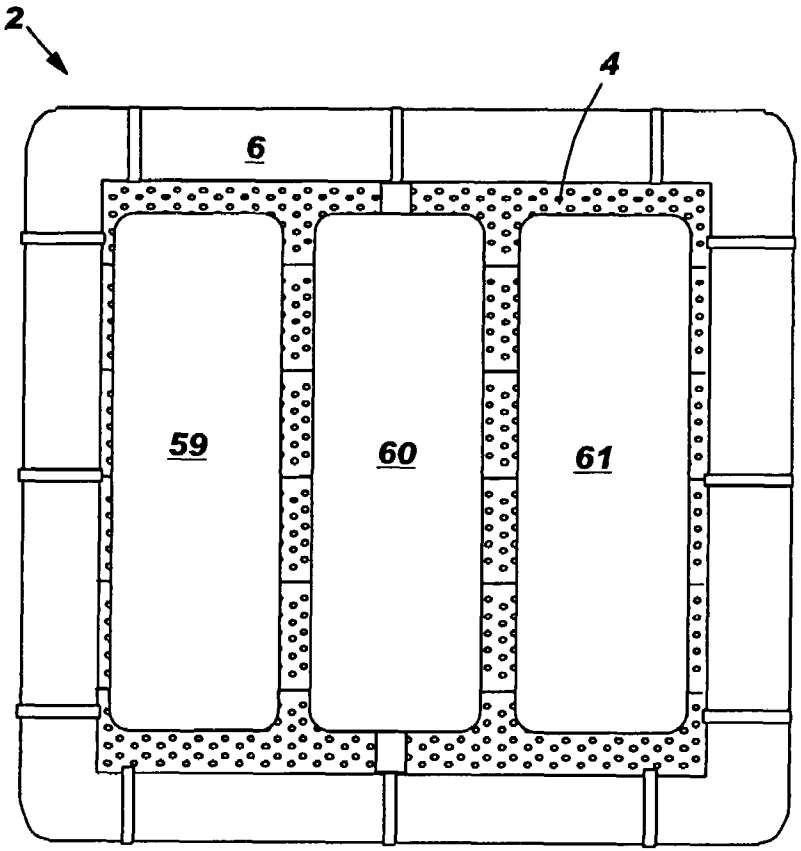
FIG. 3 illustrates an alternative to FIG. 2 showing a perspective bottom view of the portable floatation apparatus of FIG. 2 with alternative buoyancy structures, in accordance with embodiments of the present invention.

FIG. 3 illustrates an alternative to FIG. 2 showing a bottom view of the portable floatation apparatus 2 of FIG. 2 with alternative buoyancy structures 59, 60, and 61, in accordance with embodiments of the present invention. The buoyancy structures 59, 60, and 61 are removably attached to the portable floatation apparatus 2. The buoyancy structures 59, 60, and 61 may be removably attached to the buoyancy structure 6 and/or the platform structure 4. Each of the buoyancy structures 59, 60, and 61 may comprise any shape known to a person of ordinary skill in the art including, inter alia, square, triangular, hexagon, polygon, circular, etc. The buoyancy structures 59, 60, and 61 may be any buoyant structures known to a person of ordinary skill in the art including, inter alia, an inflatable buoyancy structure, a hollow tubular (e.g., using polyvinylchloride (PVC) tubing) buoyancy structure, a polystyrene buoyancy structure, etc. The buoyancy structures 59, 60, and 61 may comprise any buoyant material known to a person of ordinary skill in the art including, inter alia, plastic, PVC, polystyrene, wood, etc.

Figure 4:
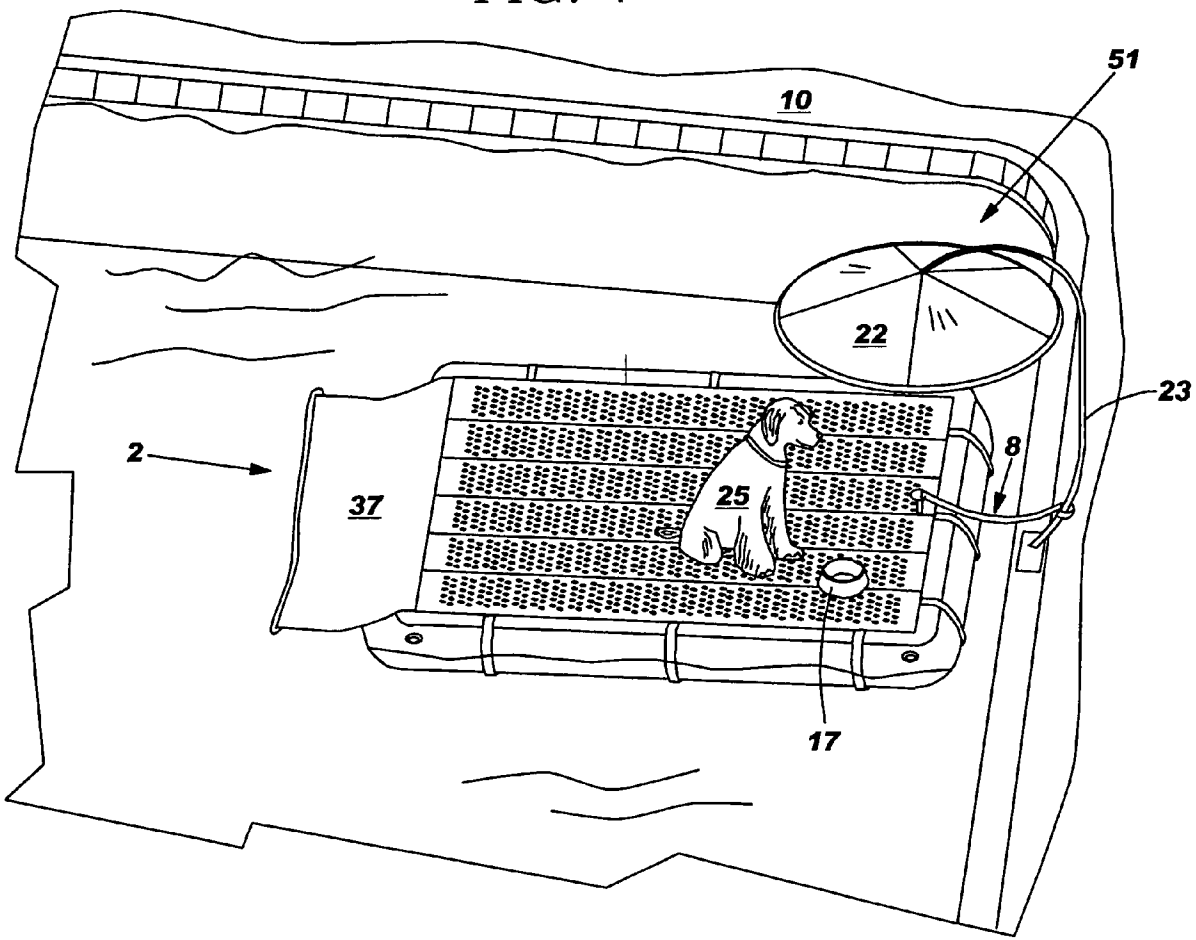
FIG. 4 illustrates a top view of the portable floatation apparatus of FIGS. 1-3 supporting an animal in a swimming pool, in accordance with embodiments of the present invention.

FIG. 4 illustrates a top view of the portable floatation apparatus 2 of FIGS. 1-3 supporting an animal 25 (e.g., a pet dog, a pet cat, etc.) in a swimming pool 10, in accordance with embodiments of the present invention. Note that although the portable floatation apparatus 2 of FIG. 4 is shown floating in a swimming pool 10, the portable floatation apparatus 2 of FIG. 4. May alternatively be used in any body of water including, inter alia, a lake a river, an ocean, etc. The swimming pool 10 may be any swimming pool known to a person of ordinary skill in the art such as, inter alia, above ground swimming pool as shown in FIG. 3, in ground swimming pool, etc. In contrast to FIG. 1, the shading structure 51 in FIG. 4 is removably attached to the pool 10 instead of the to floatation apparatus 2. The at least one attachment structure 8 may secure the floatation apparatus 2 to the shading structure 51. Note that the at least one attachment structure 8 may secure the floatation apparatus2 to any location on the swimming pool 10.

Figure 5:
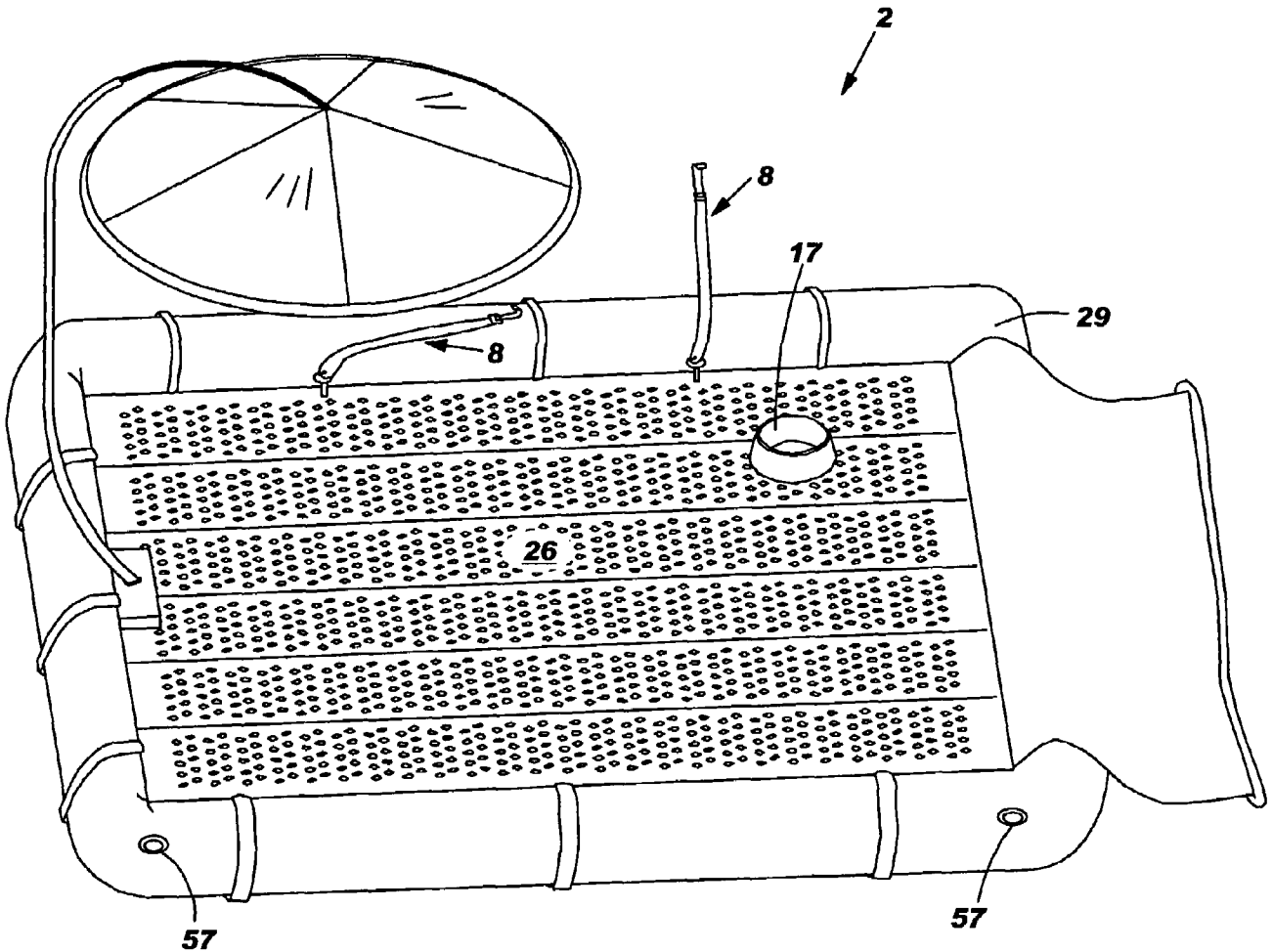
FIG. 5 illustrates an alternative embodiment to FIG. 1 showing a three dimensional view of the portable floatation apparatus with a recessed platform structure physically attached to buoyancy structure, in accordance with embodiments of the present invention.

FIG. 5 illustrates an alternative embodiment to FIG. 1 showing a perspective view of the portable floatation apparatus 2 with a recessed platform structure 26 physically attached to buoyancy structure 6, in accordance with embodiments of the present invention. The recessed platform structure 26 is recessed with respect a top surface 29 of the buoyancy structure 6 (i.e., the recessed platform structure 26 lies in a first plane, the top surface 29 of the buoyancy structure 6 lies in a second plane, and the first plane and the second plane are not a same plane).

Figure 6:
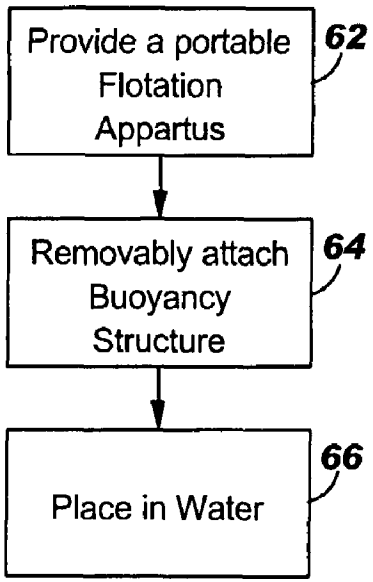
FIG. 6 is a flowchart showing an algorithm for using the portable floatation apparatus of FIGS. 1-5, in accordance with embodiments of the present invention.

FIG. 6 is a flowchart showing an algorithm 59 for using the portable floatation apparatus 2 of FIGS. 1-5, in accordance with embodiments of the present invention. In step 62, the portable floatation apparatus 2 is provided. The portable floatation apparatus 2 comprises a permanent buoyancy structure 6 physically attached to a first side of a platform structure as described in the description of FIG. 1. In step 64, buoyancy structures 43 and/or 46 (see FIG. 2) or buoyancy structures 59, 60, and/or 61 (see FIG. 3) are removably attached to the buoyancy structure 6 and/or the platform structure 4. In step 66, the portable floatation apparatus 2 is placed in water for use. As described in the description if FIG. 1, the floatation apparatus 2 may be used in any body of water including, inter alia, a swimming pool (e.g., swimming pool 10 in FIG. 4), a lake, a river, an ocean, etc.

Figure 7:
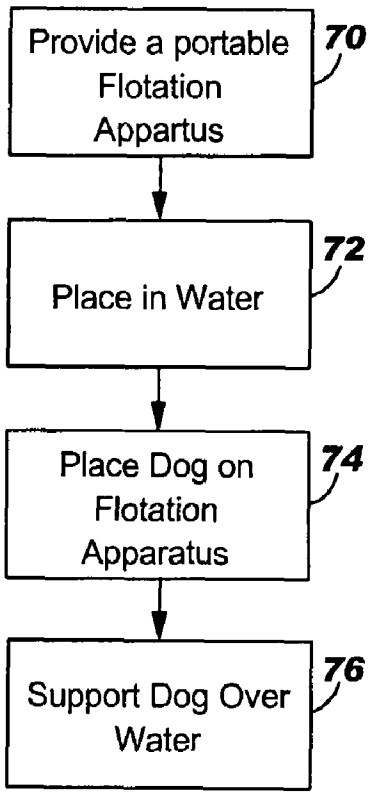
FIG. 7 is a flowchart showing an alternative algorithm for using the portable floatation apparatus of FIGS. 1-5, in accordance with embodiments of the present invention.

FIG. 7 is a flowchart showing an alternative algorithm 67 for using the portable floatation apparatus 2 of FIGS. 1-5, in accordance with embodiments of the present invention. In step 70, the portable floatation apparatus 2 is provided. The portable floatation apparatus 2 comprises a permanent buoyancy structure 6 physically attached to a first side of a platform structure as described in the description of FIG. 1. In step 72, the portable floatation apparatus 2 is placed in water for use. As described in the description if FIG. 1, the floatation apparatus 2 may be used in any body of water including, inter alia, a swimming pool (e.g., swimming pool 10 in FIG. 4), a lake, a river, an ocean, etc. In step 74, a dog 25 (see FIG. 4) is placed on the portable floatation apparatus 2. In step 76, the dog 25 (see FIG. 4) is supported over the water by the portable floatation apparatus 2.

While embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A floatation apparatus, comprising:

a platform structure, wherein the platform structure comprises perforations adapted to drain a liquid from the platform structure;

a permanent buoyancy structure physically attached to a first side of the platform structure; and at least one removable buoyancy structure removably attached to the platform apparatus, wherein the floatation apparatus is portable, wherein the floatation apparatus is adapted to float on water, wherein the platform structure is adapted to support a pet over the water; and a membrane structure removably attached to a bottom side of the floatation apparatus, wherein the membrane structure is adapted to capture the liquid draining through the perforations.

2. The floatation apparatus of claim 1, further comprising at least one attachment structure adapted to secure the floatation apparatus to an object.

3. The floatation apparatus of claim 2, wherein the object is a swimming pool.

4. The floatation apparatus of claim 3, wherein the swimming pool comprises a shading structure removably attached to the swimming pool, wherein the floatation apparatus is further adapted to be secured to the shading structure, and wherein the shading structure is adapted to provide shade for the floatation apparatus.

5. The floatation apparatus of claim 4, wherein the shading structure is selected from the group consisting of an umbrella and a canopy.

6. The floatation apparatus of claim 2, wherein the object is selected from the group consisting of a dock and a boat.

7. The floatation apparatus of claim 1, wherein the permanent buoyancy structure is selected from the group consisting of an inflatable buoyancy structure, a hoilow tubular buoyancy structure, and a polystyrene buoyancy structure.

8. The floatation apparatus of claim 1, wherein the perntanent buoyancy structure comprises a material selected from the group consisting of PVC, and polystyrene.

9. The floatation apparatus of claim 1, wherein the at least one removable buoyancy structure is an inflatable floatation structure.

10. The floatation apparatus of claim 1, wherein the an least one removable buoyancy structure comprises a material selected from the group consisting of polyvinylchloride, and polystyrene.

11. The floatation apparatus of claim 1, wherein the platform structure comprises a material selected from the consisting of PVC, plastic, wood, and fiberglass.

12. The floatation apparatus of claim 1, wherein the floatation apparatus is adapted to float on water, and wherein the platform structure is adapted to support a pet over the water.

13. The floatation apparatus of claim 1, further comprising a ramp structure, wherein the ramp structure is removably attached to the floatation apparatus, and wherein the ramp structure is adapted to support a pet over the water.

14. The floatation apparatus of claim 1, further comprising a barrier structure around a perimeter of the platform structure, wherein the barrier structure is removably attached to the floatation apparatus, and wherein the barrier structure is adapted to restrain a pet from exiting the floatation apparatus.

15. A flotation apparatus, comprising:

a platform having an upper surface, a lower surface, and a perimeter;

a buoyancy structure having a top surface and a perimeter, wherein the buoyancy structure is non-removably attached to the platform along the perimeter of the platform so that the upper surface of the platform is recessed with respect to the top surface of the buoyancy structure;

a plurality of nested endless tubular structures extending proximate the perimeter of the platform, wherein each endless tubular structure is buoyant and removably attached to the lower surface of the platform, wherein the largest of the endless tubular structures is adjacent the non-removably attached buoyancy structure and has a perimeter less than or equal to the perimeter of the platform, wherein each succeeding adjacent tubular structure has a smaller perimeter than a preceding endless tubular structure.

16. The floatation apparatus of claim 15, further comprising at least one attachment structure selected from the group consisting of a hook at each end of a strap, an eye bolt at each end of a strap, and a hook and an eye bolt at each end of a strap, wherein one end of the strap is attachable to the floatation apparatus and the other end of the strap is attachable to an object, in order to secure the floatation apparatus to the object.

17. The floatation apparatus of claim 16, wherein the object is a railing of a swimming pool.

18. The floatation apparatus of claim 16, wherein the object is selected from the group consisting of a dock and a boat.

19. The floatation apparatus of claim 15, further comprising at least one resilient member, wherein one end of the resilient member is attachable to a shading structure and the other end of the resilient member is attached to the floatation apparatus.

20. The floatation apparatus of claim 19, wherein the shading structure is selected from the group consisting of an umbrella and a canopy.

21. The floatation apparatus of claim 15, wherein the non-removably attached buoyancy structure is selected from the group consisting of an inflatable buoyancy structure, a hollow tubular buoyancy structure, and a polystyrene buoyancy structure.

22. The floatation apparatus of claim 15, wherein the non-removably attached buoyancy structure comprises a material selected from the group consisting of PVC, and polystyrene.

23. The floatation apparatus of claim 15, wherein the at least one endless tubular structure is an inflatable floatation structure.

24. The floatation apparatus of claim 15, wherein the at least one endless tubular structure comprises a material selected from the group consisting of polyvinylchloride, and polystyrene.

25. The floatation apparatus of claim 15, wherein the platform comprises a material selected from the group consisting of PVC, plastic, wood, and fiberglass.

26. The floatation apparatus of claim 15, further comprising a ramp, wherein the ramp is removably attached to the floatation apparatus, and wherein the ramp is adapted to support a pet over the water.

27. The floatation apparatus of claim 15, further comprising a barrier structure around the perimeter of the platform, wherein the barrier structure is removably attached to the floatation apparatus, and wherein the barrier structure is adapted to restrain a pet from exiting the floatation apparatus.

28. The floatation apparatus of claim 15, wherein the platform comprises perforations adapted to drain a liquid from the platform.

* * * * *